United States Patent [19]

Anderson

[11] Patent Number: 4,597,831

[45] Date of Patent: Jul. 1, 1986

[54] USE OF FOAM IN SURFACE TREATMENT OF PAPER

[76] Inventor: Thomas E. Anderson, 1 Gibbs Hill, Headcorn, Ashford, Kent, England

[21] Appl. No.: 745,369

[22] Filed: Jun. 17, 1985

Related U.S. Application Data

[63] Continuation of Ser. No. 546,425, Oct. 28, 1983, abandoned, which is a continuation-in-part of Ser. No. 956,983, Oct. 31, 1978, abandoned.

[30] Foreign Application Priority Data

Nov. 8, 1977 [GB] United Kingdom ..... 46444/77
May 31, 1978 [GB] United Kingdom ..... 46444/77

[51] Int. Cl.[4] ..... D21H 1/34

[52] U.S. Cl. ..... 162/135; 162/158; 162/175; 162/180; 162/186; 427/350; 427/355; 427/356; 427/358; 427/373; 427/395

[58] Field of Search ..... 162/101, 135, 136, 158, 162/186, 180, 175, 172; 427/358, 373, 244, 356, 296, 350, 395, 352, 355; 106/122

[56] References Cited

U.S. PATENT DOCUMENTS 2,370,058 2/1945 Maguire ..... 252/356
2,593,008 4/1952 Chappell ..... 106/88
3,494,824 2/1970 Roberts ..... 162/152
4,184,914 1/1980 Jenkins ..... 162/135

FOREIGN PATENT DOCUMENTS 1039540 11/1964 United Kingdom .

OTHER PUBLICATIONS

Riddell et al., "The White-End Concept by the Use of Foam", Paper Tech. & Ind., Jul. 1977, pp. 176–180.
Riddell et al., "Three Developments at Wolvercote Papermill", Paper Tech & Ind., Apr., 1976, pp. 76–85.
Schwartz, *Surface Active Agents and Detergents,* vol. II, (1958), pp. 327, 332, 464.
Casey, *Pulp and Paper,* vol. III, 3rd Ed., (1981), pp. 1560, 1561.

*Primary Examiner*—Peter Chin
*Attorney, Agent, or Firm*—Browdy and Neimark

[57] ABSTRACT

Paper sheet or board is externally sized by applying to the surface thereof a rosin-based sizing agent in the form of a foam in the production of which the sizing agent itself acts as a foaming agent. After the foam has been applied to the surface of the paper sheet or board, at least a major proportion of the applied foam is mechanically broken down to provide a substantially uniform distribution of the sizing agent over the surface.

7 Claims, No Drawings

USE OF FOAM IN SURFACE TREATMENT OF PAPER

This is a continuation of application Ser. No. 546,425 filed Oct. 28, 1983 abandoned, which is a continuation in part of Ser. No. 956,983 filed Oct. 31, 1978 now abandoned.

FIELD OF INVENTION

This invention relates to the surface treatment of nonwoven cellulosic fibrous material such as paper and board to make it less absorbent to water.

BACKGROUND OF INVENTION

In the manufacture of paper and paperboard from cellulosic material, it is customary to use a sizing agent either at the wet end (known as internal sizing), or in the drying section of the papermaking machine, in order to increase the resistance of the paper or board to wetting and penetration by liquids, particularly aqueous liquids, and hence provide the cellulosic material with a degree of water repellency. Application of a sizing agent in the drying section of the machine is normally referred to as surface sizing (or external sizing) of the paper sheet or board. Various hydrophobic materials are used as external sizing agents, including rosin or rosin derivatives, paraffin waxes, synthetic resins and chemically reactive sizing agents, for instance alkyl ketene dimers. External sizing agents are usually applied by roll application at the size press in the drying section of the papermaking machine.

It has been proposed in British Patent Specification No. 1,039,540 to apply to a substantially dry paper sheet or board a liquid coating composition in the form of a foam in order to reduce the wetting effect thereon of the liquid medium present in the coating composition (and consequently the amount of subsequent drying necessary to return the paper sheet or board to its dry state) and thereafter mechanically to disintegrate the foam and form a continuous surface coating on the paper sheet or board. The coating composition may incorporate conventional coating materials, for example, china clay, starch, waxes, resins, rosin, titanium dioxide pigment or carboxymethylcellulose. In order to produce the foam, the coating composition must contain a foaming agent, for example, a surface active agent such as sodium lauryl sulphate. However, it is now known that even relatively low addition levels of surfactants that cause foaming, such as sodium lauryl sulphate, have a deleterious effect on the degree of sizing of paper sheet or board. It is probably principally for this reason that the coating method proposed in the aforementioned specification never achieved general acceptance in the paper industry, especially since in papermaking systems where recycling of paper and treatment materials takes place, any foamable surfactant present in the system would tend to build up in the wet end of the papermaking machine and consequently affect both internal and external sizing, and would have other deleterious effects, including a build-up of foam.

It is well known in the papermaking art that the presence of foam in the wet end of the system is generally to be avoided, particularly where recycling of paper or treatment materials occurs, because the foam affects the appearance and quality of the finished paper. Foam build-up can be reduced by addition of defoamer, (e.g. see Example 1 of British Patent No. 1,039,540), but this is only a partial solution and increases the manufacturing costs. The concentration of foamable surfactant would therefore have to be reduced by the release of some recirculating water to effluent and replacement with fresh water, which could lead to pollution problems.

Other patents which show the application of foam to a substrate are U.S. Pat. Nos. to Read, et al., 3,210,240 and Ashmus, et al, U.S. Pat. No. 4,023,526. Read, et al. indicate that paper can be "sized" using a composition that contains a conventional wetting agent or surfactant to aid the production of foam, the "sizing" material being starch. Ashmus, et al. mention treating compositions containing a conventional surface active agent as a foaming agent, functional or treating chemicals, wetting and foam-stabilizing agents, and water. The processes of these disclosures suffer from the disadvantages resulting from the aforementioned build-up of foam.

SUMMARY OF INVENTION

We have now surprisingly found that certain conventional sizing agents when present in an aqueous carrier can be foamed with a gas or vapor, preferably air, without the use of a foamable surface active agent (surfactant) to produce the foam, and that by applying the sizing agent in foam form, if desired, together with chemical paper additives, it is possible to obtain the advantages of foam application without the concomitant disadvantages previously mentioned.

In the present specification, the terms "sized", "sizing" and "size" are used in their technically correct meanings, i.e., the rendering of paper or board less absorbent to water. This type of sizing should not be confused with the less technically correct meaning sometimes loosely used, namely merely the surface treatment of paper in order to improve the surface qualities thereof. The use of starch, as in the Read, et al. U.S. Pat. No. 3,210,240 is not "sizing" according to the technically correct meaning and according to the definition as used in the present specification.

Thus in accordance with the present invention, there is provided a method of externally sizing a paper sheet or board, which comprises applying to a surface area of the paper sheet or board stable a foam produced by foaming with a gas or vapor a foamable liquid comprising as the foam stabilizer a sizing agent of rosin or a derivative thereof in the substantial absence of an amount, sufficient to cause foaming of said liquid, of a foamable surfactant, and thereafter mechanically breaking down at least a major proportion of the applied foam in a manner such as to provide a substantially uniform application of the sizing agent over said surface area.

Since the sizing agent itself acts as the foaming agent, the normal fixing precipitation of retention of the sizing agent in the treated paper or board by the process conditions existing in a papermaking system will ensure that there is no disadvantageous build-up of foaming agent in the manufacturing process or in the associated effluent system.

The foamed sizing agent can also act as a carrier for chemical additives for the paper sheet or board, and hence by means of the present invention, it is possible to apply an external sizing agent and a chemical additive simultaneously in a single step without either deleteriously affecting the degree of sizing or causing a disadvantageous build-up of synthetic foaming agent. The invention also makes it possible to enhance the degree of sizing of the paper or board by appropriate choice of reagents and conditions.

Sizing agents that can be applied as an aqueous foam in accordance with the invention comprise sizing agents based on natural rosin or derivatives thereof. The rosin may be in the form of a soap (i.e., a salt or resinate) formed by partially or completely neutralizing rosin with an alkali metal hydroxide or salt; for example, sodium hydroxide or carbonate. Neutralization may also be effected with a volatile inorganic or organic base; e.g., ammonia or triethanolamine. If desired, the rosin, prior to neutralization, can be modified by isomerization, disproportionation, hydrogenation, or polymerization, or by reaction with, for example, formaldehyde. The modification processes may be effected in any desired order. In addition or alternatively, the resin may be reacted with a Diels-Alder type reactant, such as, for instance, maleic anhydride or fumaric acid, to form an adduct, which if desired can be saponified. Such adducts or the soaps of such adducts are referred to as fortified rosin sizes, and can be used either alone or in conjunction with normal rosin or rosin soaps. Alternatively, the rosin may be in the form of an ester of rosin or of a modified rosin. The rosin-based sizing agent, prior to foaming, will generally be in the form of a solution, emulsion, or dispersion in an aqueous medium.

The rosin-based sizing agent may be supplemented with other nonfoamable sizing agents, such as, for example:

(1) Sizing agents based on waxes. The wax may be a natural wax, for example, a paraffin wax, or a synthetic wax, for example, a halogenated wax, and when combined with the aqueous rosin-based sizing agent will be in the form of an emulsion.

(2) Chemically reactive synthetic sizing agents. These include ketene dimers, fatty acid anhydrides such as distearic anhydride and dicarboxylic acid anhydrides such as alkyl succinic anhydrides. These sizing agents, when combined with the rosin-based sizing agent, will be in the form of an emulsion.

As previously mentioned, the foamed sizing agent may, if desired, act as carrier for chemical additives for paper sheet or board which do not substantially inhibit foaming of the rosin-based sizing agent and which do not themselves act as foaming agents. Examples of additives that may be applied in this manner include dry strength resins such as starch, natural and synthetic gums, and sodium carboxymethylcellulose, wet strength resins, polysaccharides and derivatives thereof, halogenated hydrocarbons, and dyestuffs.

The mechanical breaking down of the foam after its application to the paper sheet or board may be effected in any suitable manner. For instance, where the foam is applied to the sheet while still on the wire or foraminous former, mechanical breakdown of the foam may be effected by the action of the suction boxes that are located adjacent to the wire or former. Where the foam is applied subsequently to the paper sheet, the mechanical breakdown may be effected by means of a knife edge or blade extending across the width of the sheet or by means of rolls, rods or an air knife.

For a better understanding of the invention the following illustrative examples will now be given.

EXAMPLE I

A solution of hydroxyethylated starch (Penford Gum 290) containing 5% solids was prepared by heating the starch and water at 200° F. for 15 minutes.

The starch solution was converted to a foam, using unfortified rosin size to stabilize the foam, by heating to 120° F., mixing with air, and pumping through a 28" long ½" pipe packed with stainless steel turnings. The foam was applied to the surface of paper at the size press of an experimental paper machine. The paper, made from a 50:50 mixture of bleached-hardwood/bleached-softwood pulps beaten to a Canadian Standard Freeness of 500 ml, was first internally sized by adding 0.25% high-free-rosin emulsion size (Neuphor® 100) and 1.25% alum to the wet end of the machine.

The foam thus produced was applied to the upper (felt) side of the paper in the size press. For comparison, a second foam was prepared and applied in the same way, using a conventional foaming agent in place of the rosin size, namely the ammonium salt of sulfated ethoxylated nonylphenol (Alipal® CO436).

Both forming agents were used at a level of 0.4 weight percent based on the starch solution, and the foams were pumped at a rate such that approximately 0.5 starch was applied to the paper. The following test results were obtained on the paper before and after treatment:

| Foaming Agent | Starch | Basis Weight (lbs/3000 sq. ft.) | Hercules Sizing Test (sec.) | Mullen Burst (psi) |
|---|---|---|---|---|
| None | None | 50.8 | 260 | 19 |
| None | Penford Gum 290 | 49.2 | Foam not stable | |
| Rosin soap | Penford Gum 290 | 49.2 | 350 | 25 |
| Alipal CO436 | Penford Gum 290 | 50.9 | 14 | 23 |

These results demonstrate that (1) the rosin soap foam stabilizer contributed substantially to the sizing of the paper; (2) the commercial surfactant foam stabilizer was very detrimental to the internal sizing; and (3) the starch alone did not produce a usable foam. The Mullen Burst data also indicate that the commercial surfactant reduced the paper strength.

EXAMPLE II

An aqueous sizing agent made by saponifying wood and gum rosins with caustic potash was tested in a laboratory foam cell at a concentration of 3% by weight.

The foam cell consisted of a three-necked 1 liter flask having an air supply (at about 15 p.s.i.g.) passing through a length of glass tubing extending through one neck almost to the bottom of the flask and controlled by a valve. A shorter length of glass tubing for collection of foam extending out through another neck and was connected to a length of rubber tubing.

The flask was charged with 500 ml. of the aqueous liquidizing agent to be foamed and the foam-collection tube was adjusted so that it was just above the liquid level. The air supply was turned on and any foam produced passed through the outlet tube and was directed into a large box for collection and examination. If the foam produced was stable for 30 seconds it was considered satisfactory at this stage. An arbitrary standard, namely a shaving foam, was adopted as an indication of foam quality. The foam produced was sufficiently stable for use in the present invention.

This saponified size was tested further, using the foam generating apparatus under the following conditions:

| Size Flow Liters/ Min. | Water Flow Liters/ Min. | Total diluted solids % dry basis | Air Pressure psi | Expansion Rate Liters/ Min. | Expansion Ratio | Decay Time Minutes |
|---|---|---|---|---|---|---|
| 0.14 | 7.5 | 0.6 | 30 | 180 | 12 | 24 |

The foam produced was satisfactory for the practice of the invention. A further sample of foam having the above composition was applied in the size press to the upper (felt) side of paper similar to that used in Example I, which had been previously internally sized with a very low level of high-free-rosin emulsion size and alum. The sizing was tested as described in that Example; the results are shown in Table I.

EXAMPLE III

An aqueous sizing agent made by saponifying with caustic soda a mixture of gum and tall oil rosin that had been treated with formaldehyde and reacted with the fortifying agent fumaric acid was tested at a concentration of 4% by weight in the laboratory foam cell, following the procedure of Example II.

The foam produced was satisfactory for the practice of the invention. A further sample of foam having the above composition at a concentration of 3% was applied in the size press to the upper (felt) side of paper like that used in Example II and tested as descrbed in that Example. The results are shown in Table I.

EXAMPLE IV

An aqueous sizing agent made by saponifying and stabilizing with sodium metasilicate a gum rosin that had been fortified using maleic anhydride was tested in the laboratory foam cell at a concentration of 5% by weight, following the procedure of Example II. A satisfactory foam was produced. This sizing composition was tested further in the foam generating apparatus under the following conditions:

| Size Flow Liters/ Min. | Water Flow Liters/ Min. | Total diluted solids % dry basis | Air Pressure psi | Expansion Rate Liters/ Min. | Expansion Ratio | Decay Time Minutes |
|---|---|---|---|---|---|---|
| 0.23 | 7.5 | 1.2 | 70 | 200 | 15 | 10 |

The foam produced was satisfactory for the practice of the invention. A further sample of foam having the above composition at a concentration of 3% was applied in the size press to the upper (felt) side of paper like that used in Example II and tested as descrbed in that Example. The results are also shown in Table I.

TABLE I

| Example | Hercules Sizing Test (sec.) |
|---|---|
| II | 336 |
| III | 234 |
| IV | 325 |
| Control (Paper before foam application) | 15 |

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should, and are intended to, be comprehended within the meaning and range of equivalents of the disclosed embodiments. It is to be understood that the phraseology or terminology employed herein is for the purpose of description and not of limitation.

What I claim and desire to protect by Letters Patent is:

1. A method of externally sizing a paper sheet or board, which comprises applying to a surface of the paper sheet or board a foam produced by foaming with a gas or vapor a foamable liquid consisting essentially of a sizing agent of rosin or a derivative thereof and water, in the substantial absence of an amount, sufficient to cause foaming of said liquid, of a compound which causes foaming other than said sizing agent itself, and wherein the amount of sizing agent is a sizing-effective amount and sufficient to provide a stable foam, and thereafter mechanically breaking down at least a major proportion of the applied foam in a manner such as to provide a substantially uniform application of the sizing agent over said surface area.

2. A method according to claim 1, wherein the sizing agent comprises a rosin adduct.

3. A method according to claim 1, wherein the rosin or rosin derivative is supplemented with an additional nonfoamable sizing agent.

4. A method according to claim 2, wherein the sizing agent foam acts as a carrier for a chemical additive for the treatment of paper sheet or board, said chemical additive being one which does not act as a foaming agent.

5. A method according to claim 4, wherein the chemical additive is starch.

6. A method according to claim 2, wherein the rosin or rosin derivative is supplemented with an additional nonfoamable sizing agent.

7. A method according to claim 6, wherein the sizing agent foam acts as a carrier for a chemical additive for the treatment of paper sheet or board, said chemical additive being one which does not act as a foaming agent.

* * * * *

UNITED STATES PATENT AND TRADEMARK OFFICE

CERTIFICATE OF CORRECTION

PATENT NO. : 4,597,831

DATED : July 1, 1986

INVENTOR(S) : Thomas Edward ANDERSON

It is certified that error appears in the above-identified patent and that said Letters Patent is hereby corrected as shown below:

Column 2, line 44, change "stable a" to -- a stable --;

Column 2, line 55, change "of" (first occurrence) to -- or --.

Signed and Sealed this

Eleventh Day of November, 1986

*Attest:*

DONALD J. QUIGG

*Attesting Officer* *Commissioner of Patents and Trademarks*